United States Patent [19]

Beane

[11] 3,976,578

[45] Aug. 24, 1976

[54] PROTECTIVE SLEEVE FOR CORRUGATED DRAINAGE TUBES

[76] Inventor: Frank T. Beane, 216 Banner Ave., Concord, N.C. 28025

[22] Filed: June 25, 1974

[21] Appl. No.: 483,391

[52] U.S. Cl. ..... 210/484; 61/11; 285/260; 285/DIG. 4

[51] Int. Cl.[2] ..... E02B 13/00

[58] Field of Search ..... 285/260, DIG. 4; 61/11, 61/13, 12, 10; 210/489, 484; 138/124, 123, 121, 122, 173; 66/169 A, 178 A

[56] References Cited

UNITED STATES PATENTS

| | | | |
|---|---|---|---|
| 2,763,991 | 9/1956 | Kennon | 61/13 |
| 3,302,408 | 2/1967 | Schmid | 61/13 |
| 3,556,299 | 1/1971 | Zievers | 210/489 X |
| 3,611,735 | 10/1971 | Daczko | 61/11 X |
| 3,830,373 | 8/1974 | Sixt et al. | 61/11 X |

FOREIGN PATENTS OR APPLICATIONS

| | | | |
|---|---|---|---|
| 703,595 | 2/1954 | United Kingdom | 61/13 |

*Primary Examiner*—Thomas F. Callaghan
*Attorney, Agent, or Firm*—Clifton T. Hunt, Jr.

[57] ABSTRACT

A continuous tubular sleeve of knit fabric material, which is cylindrical in shape and, in the relaxed condition, of a diameter less than the diameter of the corrugated drainage pipe to which it is to be applied, is formed in lengths up to approximately 1,000 feet. In use, the tubular knit sleeve is cut to a desired length and slipped over one or more sections of corrugated flexible drainage pipe and acts as a filter to keep rocks, dirt, mud, pieces of clay, and the like from clogging the openings in the corrugated drainage pipe while allowing the water to pass through.

3 Claims, 2 Drawing Figures

PROTECTIVE SLEEVE FOR CORRUGATED DRAINAGE TUBES

BACKGROUND OF THE INVENTION

In recent years, the drainage pipe industry has developed new types of flexible corrugated drainage and irrigation tubing wherein the wall thereof includes alternating annular peaks and valleys and a plurality of peripheral slotted openings arranged transversely to the longitudinal axis of the tube. The Sixt U.S. Pat. No. 3,699,684 discloses in Col. 3 lines 7–11 that such drainage tubes can be coiled on a drum such as its shipping container and simply fed down into a trench immediately after it is dug. A sheet of flexible water-repellent material may be placed over the area of the tube in which the slotted openings are located. Alternatively a sheet of fine filtering material may be used instead of the water-repellent material.

Such a combination is not entirely satisfactory since the tube must be put in place and then the sheet of water-repellent material or filter material positioned in its proper place. Alternatively, it might be possible to permanently or semi-permanently attach the water-repellent material or filter material to the tube; however, these tubes must be transported, stacked, and dragged across fields. In doing so, such a type of filtering material would become dislodged or removed.

Also, U.S. Pat. Nos. 2,763,991 and 2,052,020 show systems similar to that of the aforementioned Sixt patent, however, are objectionable for one reason or another.

SUMMARY OF THE INVENTION

The present invention, on the other hand, provides an improved sleeve which completely encircles the flexible drainage pipe with a cylindrical or tubular length of relatively elastic, knit fabric material. The sleeve is of a diameter, in the relaxed condition, less than the diameter of the drainage tube. Further, the knit fabric is preferably formed by lock stitches to prevent running if a snag occurs. The sleeve may be assembled on the pipe anywhere, even in the factory, and once emplaced, will not become dislodged, removed or torn away.

In general, due to the inherent elasticity of the knit fabric, the tubular sleeve of the present invention provides a corrugated flexible drain pipe with a protective covering which is easily assembled on the pipe. Moreover, during transportation and movement of the pipe in the field, the sleeve will remain snugly in place, generally conforming to the configuration of the pipe, thereby preventing damage to the sleeve.

It is therefore an object of the present invention to improve the function of corrugated drain pipe by providing, in combination therewith, an improved, tubular, knit sleeve.

It is further an object of the present invention to provide a new and unique sleeve for corrugated drain pipes that is easier to install, remains in place, and provides more protection than those known heretofore.

Figure 1:
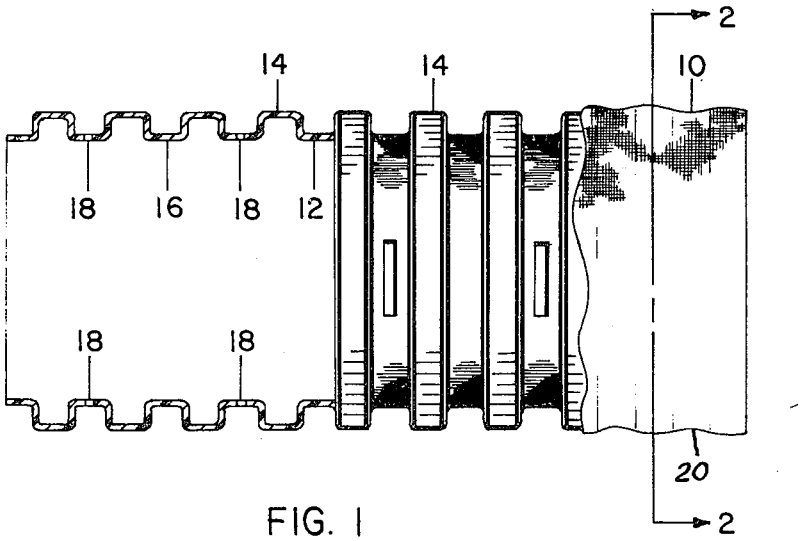
Figure 2:
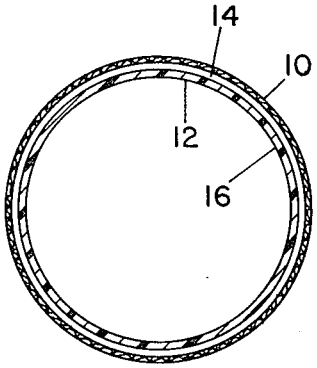

Other objects and a fuller understanding of the invention will become apparent upon reading the following specification in view of the drawings wherein:

FIG. 1 is an elevation view, partly in section, with portions broken away illustrating a length of drain pipe with the sleeve mounted thereon in accordance with the present invention; and FIG. 2 is a sectional view taken substantially along lines 2—2 in FIG. 1.

Turning now to the drawings, the invention here involved is generally directed to an improved sleeve 10 for corrugated, flexible drainage pipe 12 of the type having alternating annular peaks 14 and valleys 16 and a plurality of slotted openings 18 arranged at spaced points and extending arcuately around portions of the wall in directions transverse to the longitudinal axis of the pipe 12. The sleeve 10 comprises a continuous length of relatively elastic knit fabric which is tubular in shape and, in the relaxed condition, of a diameter less than the diameter of the corrugated drainage pipe 12, whereby when placed on pipe 12 the fabric is stretched to fit snugly therearound. The snug, stretched, inherently elastic tubular sleeve is both easier to install and resists damage or dislodgement.

The sleeve 10 itself is formed of any suitable strand material on a circular knitting machine and is knit to form a continuous cylindrical tube in lengths of up to 1,000 feet. A conventional lock stitch arrangement is used in the knitting operation, so that if a portion of the tube becomes torn during transportation or dragging along the ground, the fabric will not run. By using a continuous tubular construction, it is not necessary to provide seams which would make sizing and installation difficult, or to wrap the fabric around the tube which would not be satisfactory because of the dislodgement problem when dragging the pipes and pipe sections along the ground.

The diameter of the tubular fabric is so designed that in the relaxed condition the sleeve diameter is less than the maximum diameter of the tube for which the fabric is to be used. This provides a snug fit and prevents longitudinal displacement of the fabric once it is in place as well as twisting or wrapping around the tube. When installed, the tubular knit fabric 10 relaxes into snug tight engagement with the peaks 14 of tube 12 and undulates inwardly toward the axis of the tube as at 20 as it spans the valleys 16. The inward undulations 20 correspond with the location of the slotted openings 18.

The corrugated tube 12 is preferably fabricated of a durable, high strength polyethylene although other materials are suitable. Extruding techniques are used to shape the tubing by forcing the molten plastic through an annular orifice, as is well known. The formed plastic tube is then reshaped to form the corrugations 14,16 and transverse slotted openings 18.

The improved sleeve 10 described hereinabove covers those slotted openings and actually provides a filter so that gravel, rock, mud, dirt and the like cannot clog the openings 18 which would result in a less efficient drainage, or if the condition became bad enough, no drainage at all. The sleeve may be factory installed with assurance that transportation, assembly and installation in the field will not damage or dislodge the sleeve. The improvements to the sleeve make it more permanent and easier to install, as well as being more durable during transportation and storage.

Although a preferred embodiment of the invention has been shown and described, it is apparent that changes and modifications could be made without departing from the scope and spirit of the invention which is set forth in the following claims.

What is claimed is:

1. In combination with an elongated flexible corrugated drainage pipe capable of being rolled upon itself for storage and shipment and of the type having alternating peaks and valleys along its longitudinal axis and a plurality of openings through the pipe arranged along its longitudinal axis and located in selected valleys of the corrugated pipe, a protective permeable sleeve comprising a length of tubular knit fabric of lock-stitch construction substantially co-extensive with the length of the pipe and having a diameter in a relaxed condition less than the maximum diameter of the corrugated pipe, and said sleeve having an undulating surface when positioned on the corrugated pipe.

2. In combination with an elongated flexible tubular drainage pipe having corrugations therein forming alternating annular peaks and valleys along the longitudinal axis of the pipe and a plurality of openings through the pipe positioned in selected valleys, the combination of and a permeable tubular knit fabric sleeve surrounding said pipe and snugly engaging its peaks, said sleeve having a diameter in its relaxed condition less than the maximum diameter of the pipe, said sleeve presenting an undulating surface when positioned on the pipe, and including inward undulations corresponding with the valleys in the corrugated configuration of the pipe.

3. A structure according to claim 2 wherein the sleeve on the pipe extends inwardly toward the openings in the pipe.

* * * * *

UNITED STATES PATENT AND TRADEMARK OFFICE

CERTIFICATE OF CORRECTION

PATENT NO. : 3,976,578

DATED : August 24, 1976

INVENTOR(S) : Frank T. Beane

It is certified that error appears in the above-identified patent and that said Letters Patent are hereby corrected as shown below:

Column 4, lines 2 and 3, cancel "the combination of and";

Column 4, line 9, cancel the comma ",".

Signed and Sealed this

Nineteenth Day of October 1976

[SEAL]

*Attest:*

RUTH C. MASON
*Attesting Officer*

C. MARSHALL DANN
*Commissioner of Patents and Trademarks*